US011284761B2

(12) United States Patent
Ward et al.

(10) Patent No.: US 11,284,761 B2
(45) Date of Patent: Mar. 29, 2022

(54) CYCLONIC SEPARATION DEVICE

(71) Applicant: TTI (Macao Commercial Offshore Limited), Macau (CN)

(72) Inventors: Matthew James Ward, West Midlands (GB); Richard David Waters, West Midlands (GB); Guy Lawrence Newsom, West Midlands (GB); Darren David Holmes, West Midlands (GB); Steven James Rogers, West Midlands (GB)

(73) Assignee: Techtronic Floor Care Technology Limited, Tortola (VG)

( * ) Notice: Subject to any disclaimer, the term of this patent is extended or adjusted under 35 U.S.C. 154(b) by 562 days.

(21) Appl. No.: 16/341,823

(22) PCT Filed: Oct. 12, 2017

(86) PCT No.: PCT/GB2017/053081
§ 371 (c)(1),
(2) Date: Apr. 12, 2019

(87) PCT Pub. No.: WO2018/069708
PCT Pub. Date: Apr. 19, 2018

(65) Prior Publication Data

US 2019/0246854 A1 Aug. 15, 2019

(30) Foreign Application Priority Data

Oct. 14, 2016 (GB) ..... 1617513

(51) Int. Cl.
*A47L 9/16* (2006.01)
*B04C 5/187* (2006.01)
(Continued)

(52) U.S. Cl.
CPC ..... *A47L 9/1608* (2013.01); *A47L 5/225* (2013.01); *A47L 5/26* (2013.01); *A47L 9/0072* (2013.01);
(Continued)

(58) Field of Classification Search
USPC ..... 15/353; 55/342
See application file for complete search history.

(56) References Cited

U.S. PATENT DOCUMENTS 6,221,134 B1 4/2001 Conrad et al.
6,228,260 B1 5/2001 Conrad et al.
(Continued)

FOREIGN PATENT DOCUMENTS

CN 101664290 A 3/2010
CN 102793515 A 11/2012
(Continued)

OTHER PUBLICATIONS

International Search Report and Written Opinion for Application No. PCT/GB2017/053081 dated Apr. 3, 2018 (18 pages).
(Continued)

*Primary Examiner* — Monica S Carter
*Assistant Examiner* — Noufou Ouedraogo
(74) *Attorney, Agent, or Firm* — Michael Best & Friedrich LLP

(57) ABSTRACT

A cyclonic separator device for removing dust or debris from dirt-laden air, the device having a separating chamber, an inlet, an outlet, and a shroud that is connected to the separating chamber at one end, and provides a plurality of openings for the passage of air to the outlet. The device further includes a dirt collection chamber in communication with the separating chamber. The separating chamber includes an airflow directing formation which is connected to an inner surface of a generally cylindrical portion and
(Continued)

which extends inwardly towards a central axis of the generally cylindrical portion. The airflow directing formation provides a surface which follows a substantially helical path that extends away from the inlet as it extends circumferentially around the inner surface of the generally cylindrical portion.

29 Claims, 17 Drawing Sheets

(51) Int. Cl.

| | |
|---|---|
| ***A47L 5/22*** | (2006.01) |
| ***A47L 5/26*** | (2006.01) |
| ***A47L 9/00*** | (2006.01) |
| ***B04C 5/103*** | (2006.01) |

(52) U.S. Cl.
CPC ..... *A47L 9/165* (2013.01); *A47L 9/1666* (2013.01); *B04C 5/103* (2013.01); *B04C 5/187* (2013.01)

(56) References Cited

U.S. PATENT DOCUMENTS

| | | | | |
|---|---|---|---|---|
| 6,494,929 | B2 | 12/2002 | Wilkins | |
| 6,519,804 | B1 | 2/2003 | Vujik | |
| 6,613,129 | B2 * | 9/2003 | Gen | A47L 9/1625 55/318 |
| 6,662,450 | B1 | 12/2003 | Ducret | |
| 6,766,558 | B1 | 7/2004 | Matsumoto et al. | |
| 6,874,197 | B1 | 4/2005 | Conrad et al. | |
| 7,544,224 | B2 | 6/2009 | Tanner et al. | |
| 7,588,616 | B2 | 9/2009 | Conrad et al. | |
| 7,647,672 | B2 | 1/2010 | Nam et al. | |
| 7,789,922 | B1 | 9/2010 | Wai | |
| 7,891,045 | B2 | 2/2011 | Kim et al. | |
| 7,931,722 | B2 | 4/2011 | Sepke et al. | |
| 8,117,713 | B2 | 2/2012 | Kasper et al. | |
| 8,167,964 | B2 | 5/2012 | Wai | |
| 8,448,292 | B2 | 5/2013 | Miefalk et al. | |
| 9,060,666 | B2 | 6/2015 | Jang et al. | |
| 9,826,871 | B2 | 11/2017 | Jang et al. | |
| 10,052,579 | B2 * | 8/2018 | Hallgren | B01D 45/18 |
| 2004/0103785 | A1 * | 6/2004 | North | A47L 9/1608 95/271 |
| 2006/0230718 | A1 | 10/2006 | Han et al. | |
| 2008/0289306 | A1 | 11/2008 | Han et al. | |
| 2016/0174789 | A1 | 6/2016 | Han et al. | |

FOREIGN PATENT DOCUMENTS

| | | | |
|---|---|---|---|
| CN | 204708771 | U | 10/2015 |
| CN | 108209722 | A | 6/2018 |
| GB | 2369290 | A | 5/2002 |
| GB | 2417916 | A | 3/2006 |
| JP | S6230568 | A | 2/1987 |
| WO | 2012043007 | A1 | 4/2012 |
| WO | 2012064814 | A1 | 5/2012 |
| WO | 2015113779 | A2 | 8/2015 |

OTHER PUBLICATIONS

United Kingdom Patent Office Search Report for Application No. GB1617513.5 dated Mar. 28, 2017 (1 page).

* cited by examiner

CYCLONIC SEPARATION DEVICE

CROSS-REFERENCE TO RELATED APPLICATIONS

This application is a U.S. national phase entry of International Application No. PCT/GB2017/053081, filed Oct. 12, 2017, which claims priority to U.K. Patent Application No. 1617513.5, filed Oct. 14, 2016, the entire contents all of which are hereby incorporated by reference herein.

BACKGROUND

This invention relates to a cyclonic separation device and particularly, but not exclusively to a surface cleaning apparatus including such a device.

SUMMARY

According to a first aspect of the invention we provide a cyclonic separator device for removing dust or debris from dirt-laden air, the device having:

a separating chamber;

an inlet through which dirt-laden air is drawn into the separating chamber;

an outlet through which cleaner air exits the separating chamber; and a shroud that is connected to the separating chamber at one end, and provides a plurality of openings for the passage of air to the outlet, a dirt collection chamber in communication with the separating chamber, wherein the separating chamber includes a generally cylindrical portion with a central axis and wherein the inlet is configured to direct the incoming dirt-laden air into said generally cylindrical portion such that it travels circumferentially around an inner surface of the separating chamber, wherein the separating chamber includes an airflow directing formation which is connected to the inner surface of the generally cylindrical portion and which extends inwardly towards the central axis of the generally cylindrical portion, wherein said airflow directing formation provides a surface which follows a substantially helical path that extends away from the inlet as it extends circumferentially around the inner surface of the generally cylindrical portion.

The airflow directing formation may be connected only to the inner surface of the generally cylindrical portion of the separating chamber.

According to a second aspect of the invention we provide a surface cleaning apparatus including the device according to the first aspect of the invention.

Further features of the first and second aspects of the invention are set out in the appended claims.

BRIEF DESCRIPTION OF THE DRAWINGS

Embodiments of the invention will be set out below by way of example only with reference to the accompanying figures, of which.

DETAILED DESCRIPTION

Figure 1:
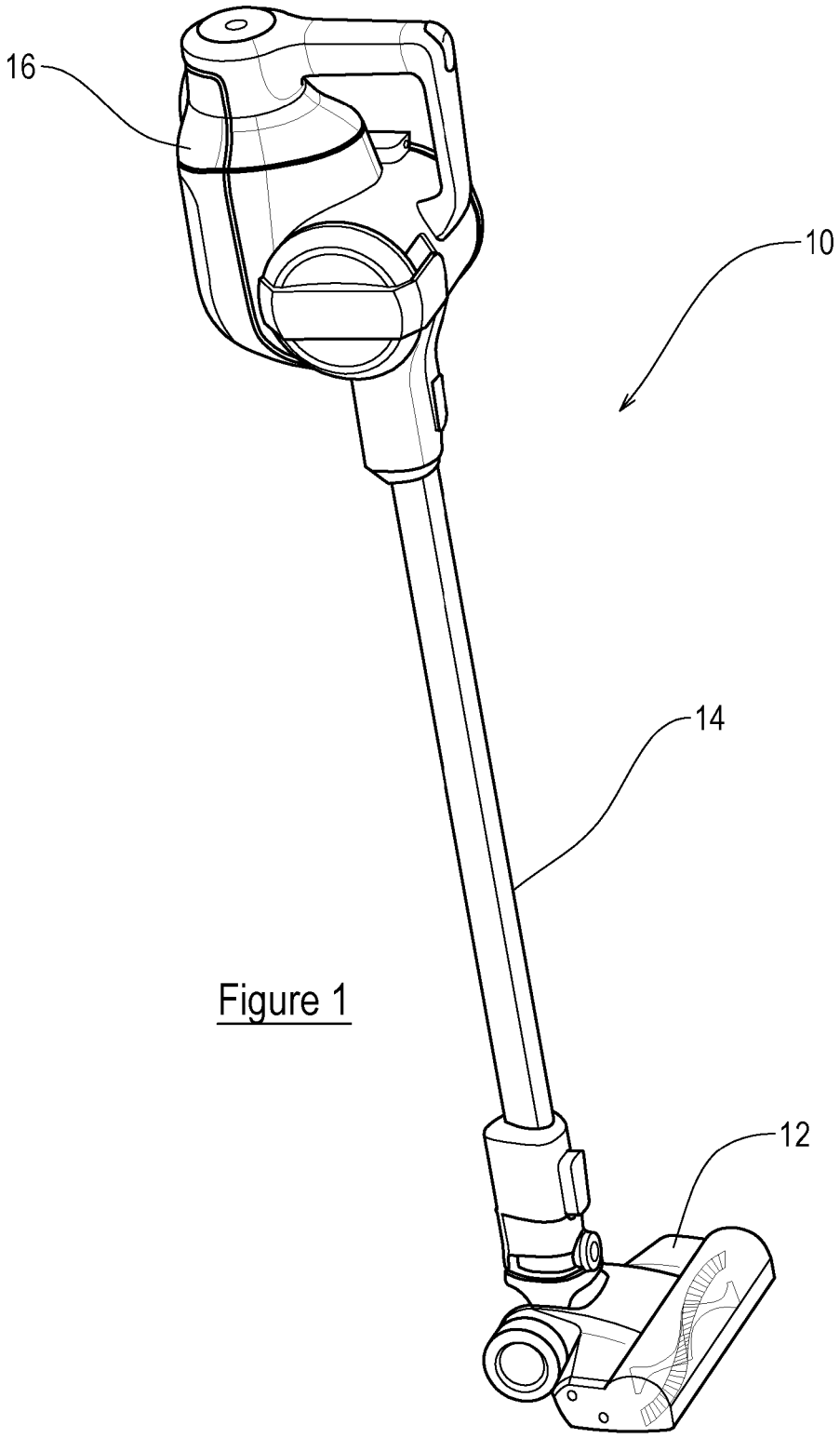
FIG. 1 is a perspective view of a surface cleaning apparatus.
Figure 2:
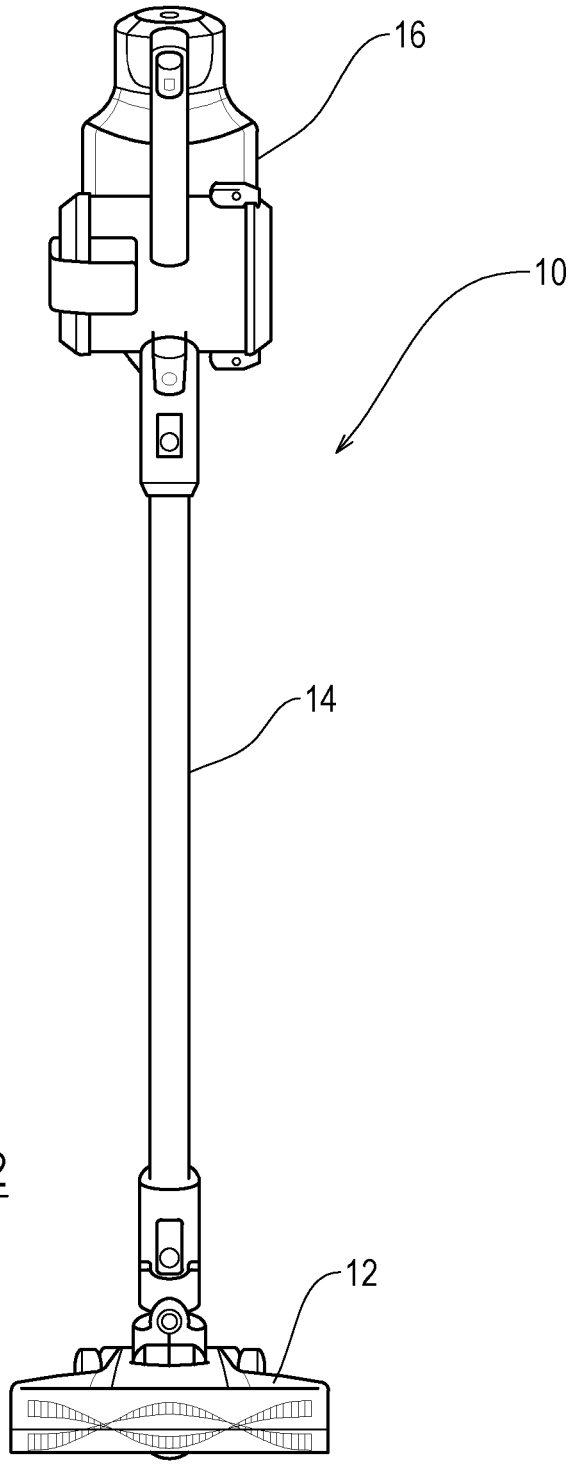
FIG. 2 is a front view of the apparatus of FIG. 1.
Figure 3:
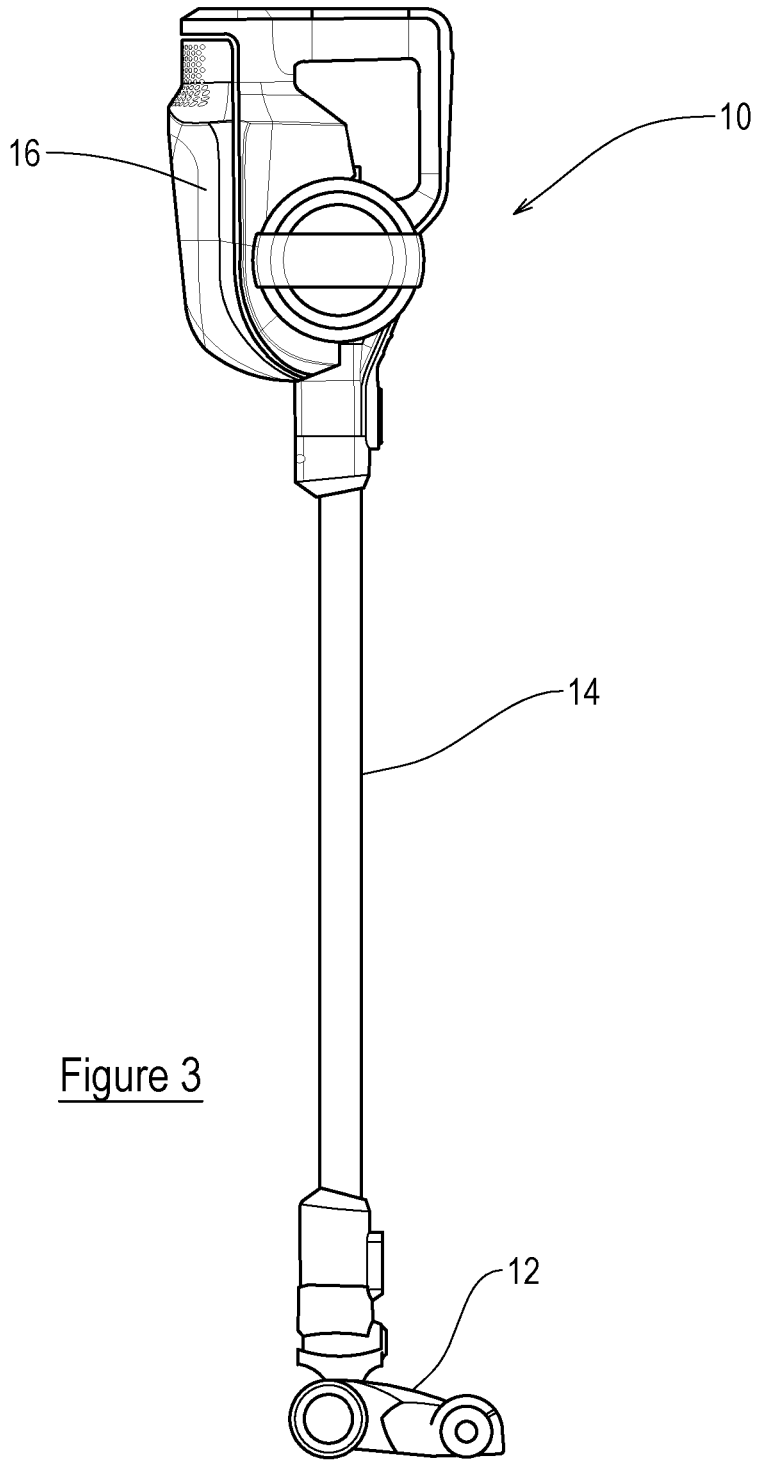
FIG. 3 is a side view of the apparatus FIG. 1.
Figure 4:
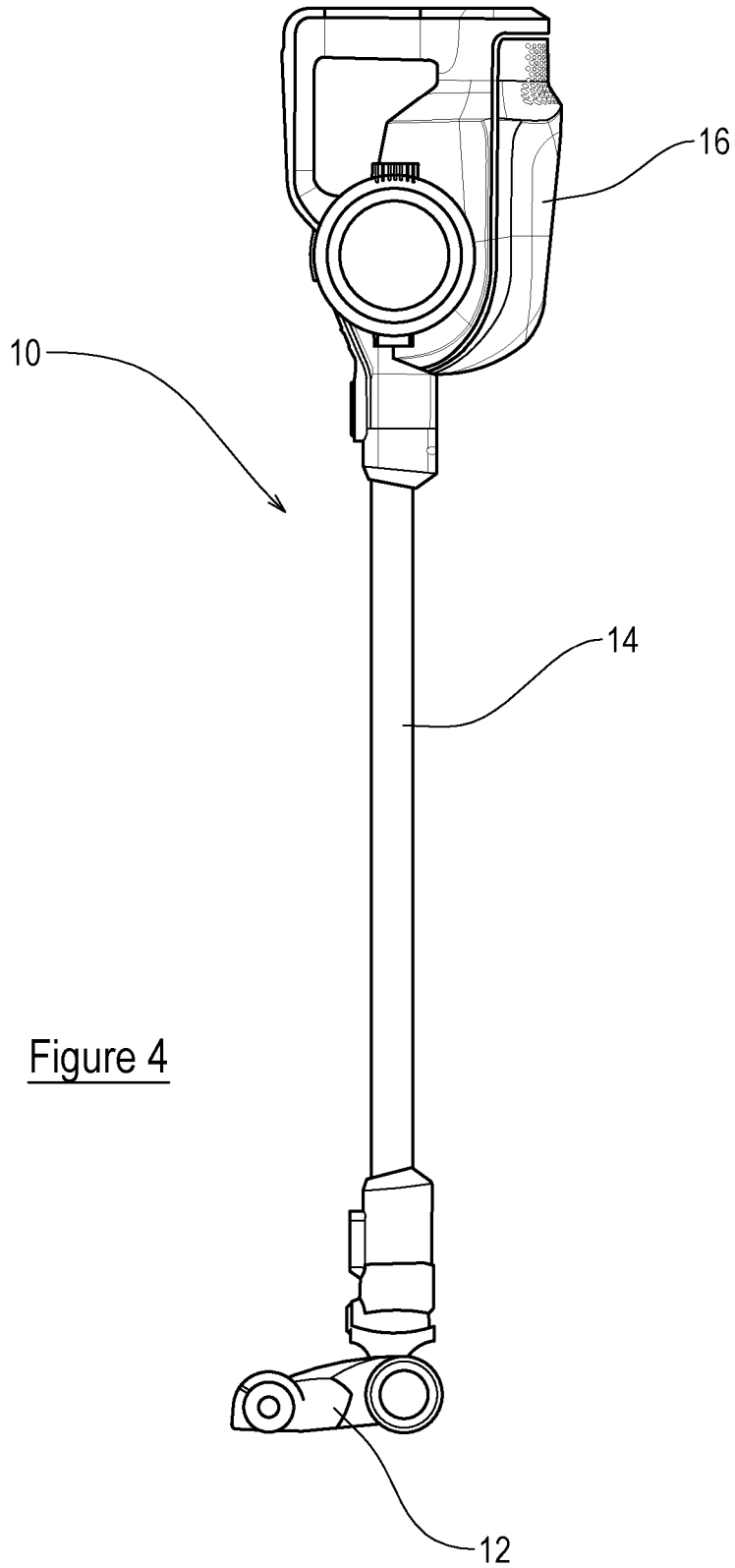
FIG. 4 is an opposite side view of the apparatus FIG. 1.
Figure 5:
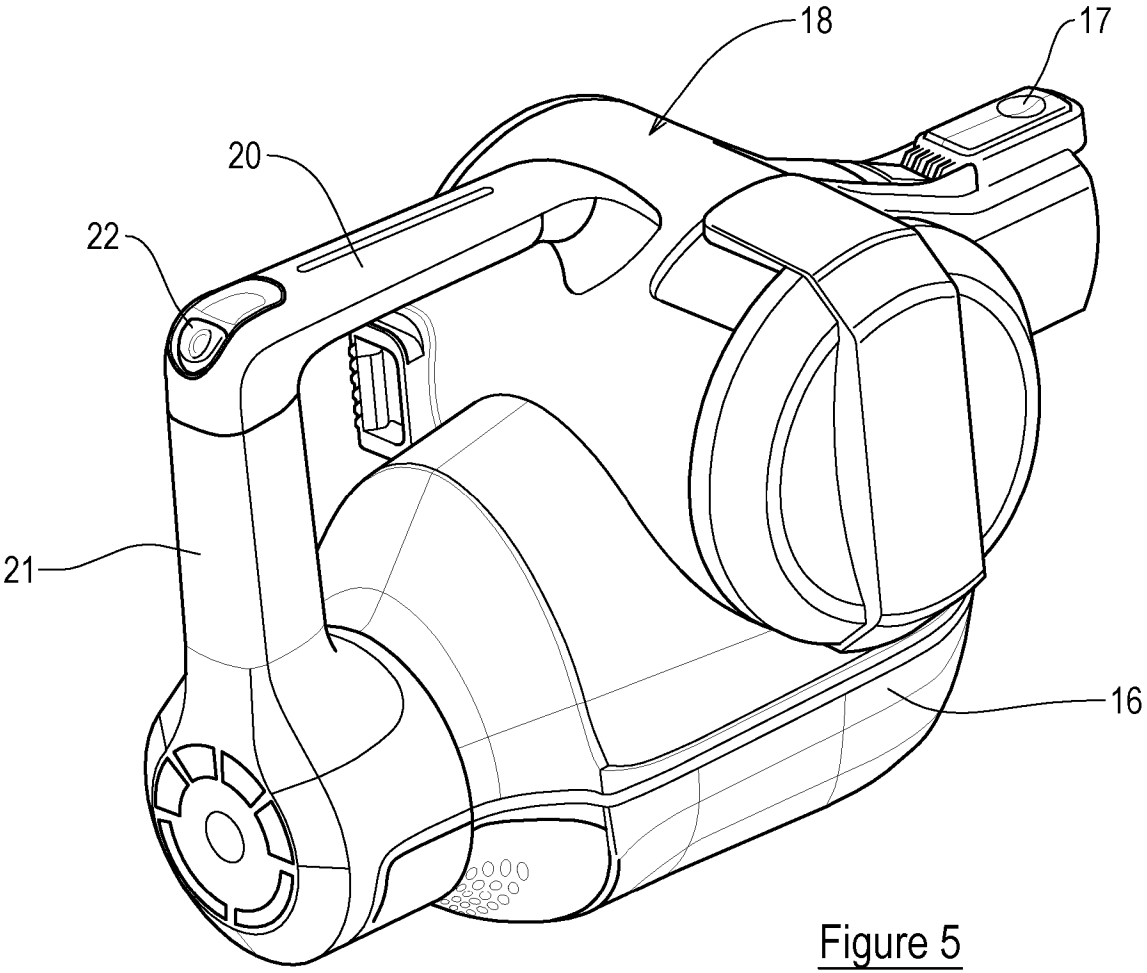
FIG. 5 is a perspective view of a housing of the apparatus of FIG. 1, which housing is operable as a handheld surface cleaning apparatus.
Figure 6:
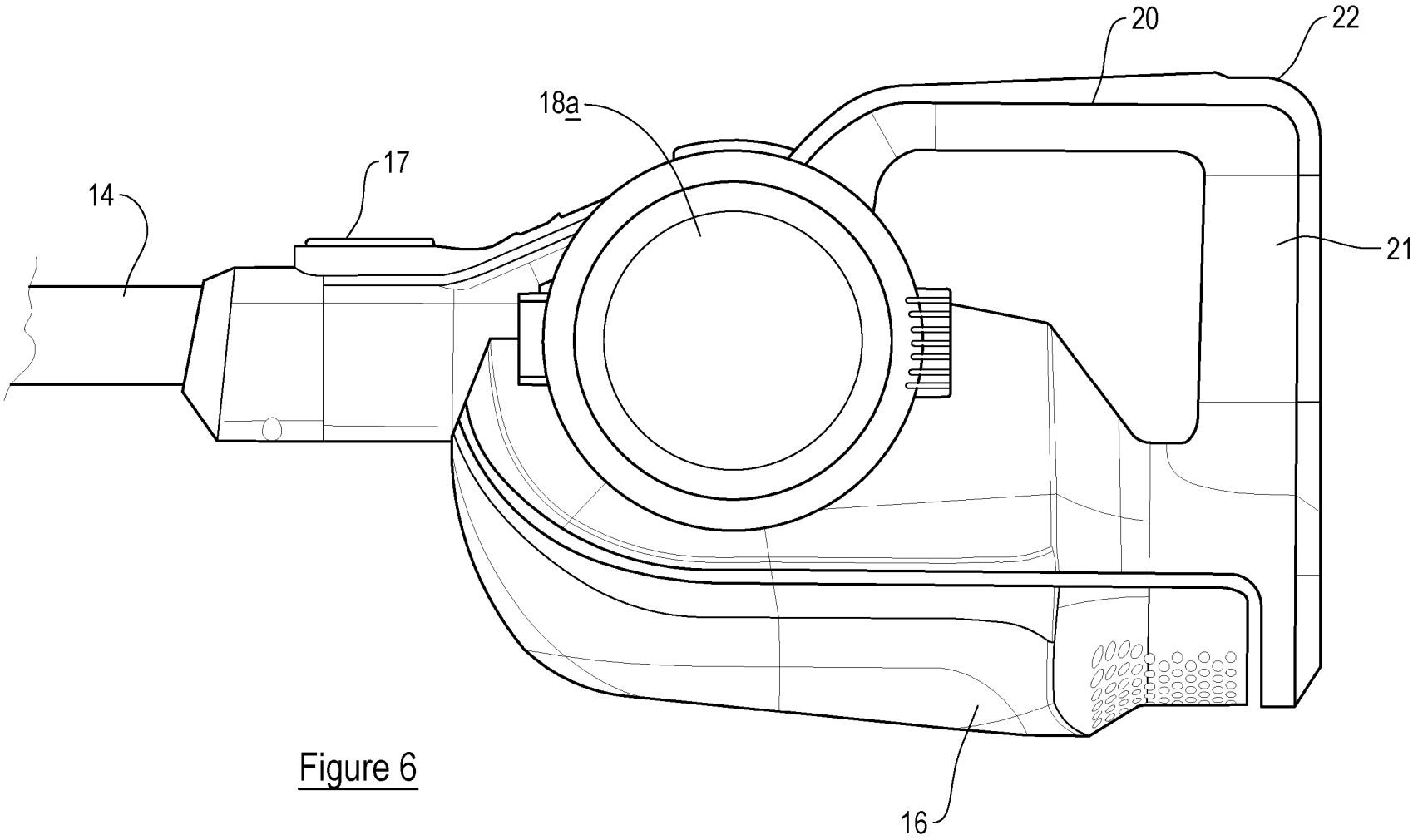
FIG. 6 is a side view of the housing of FIG. 5.
Figure 7:
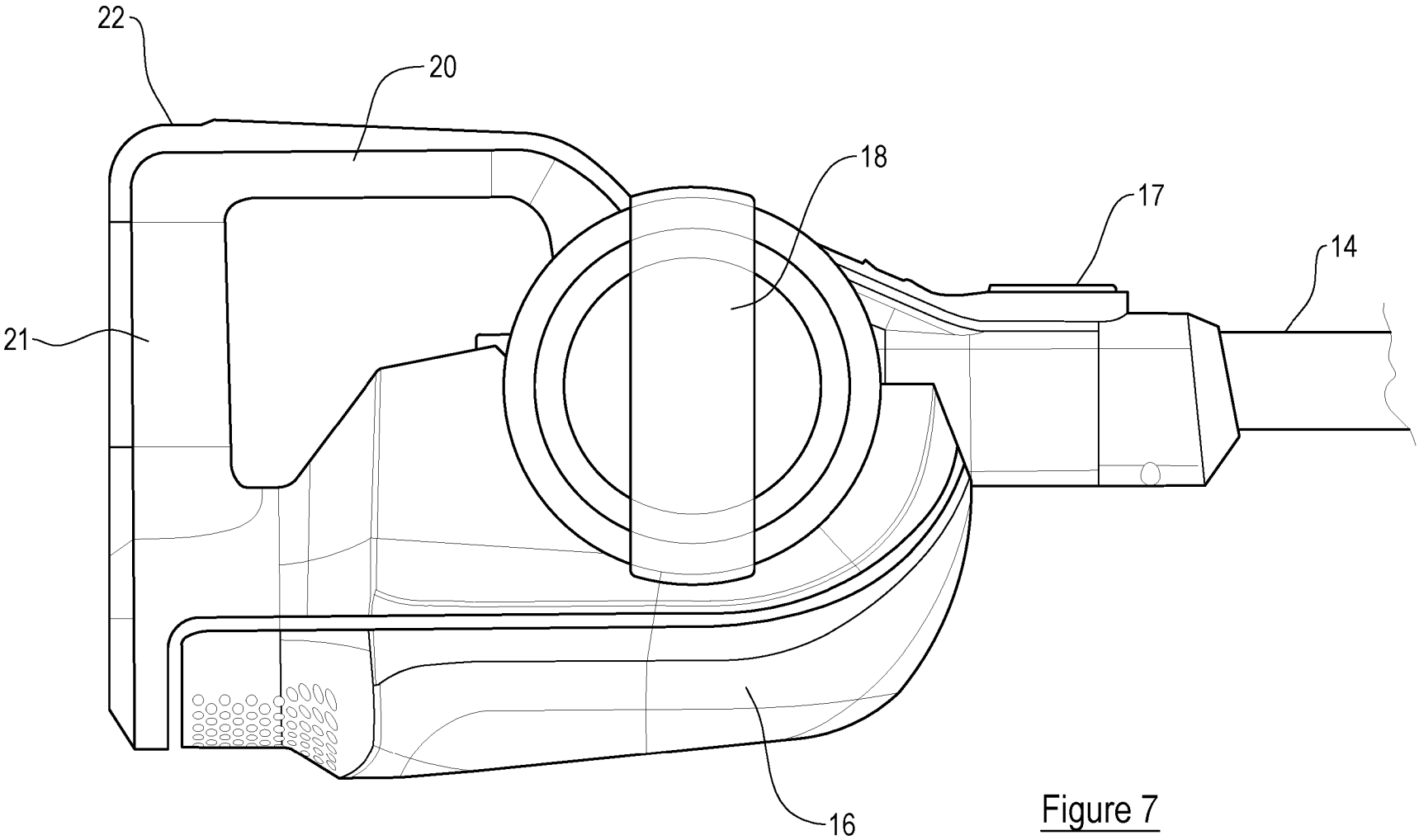
FIG. 7 is an opposite side view of the housing of FIG. 5.
Figure 8:
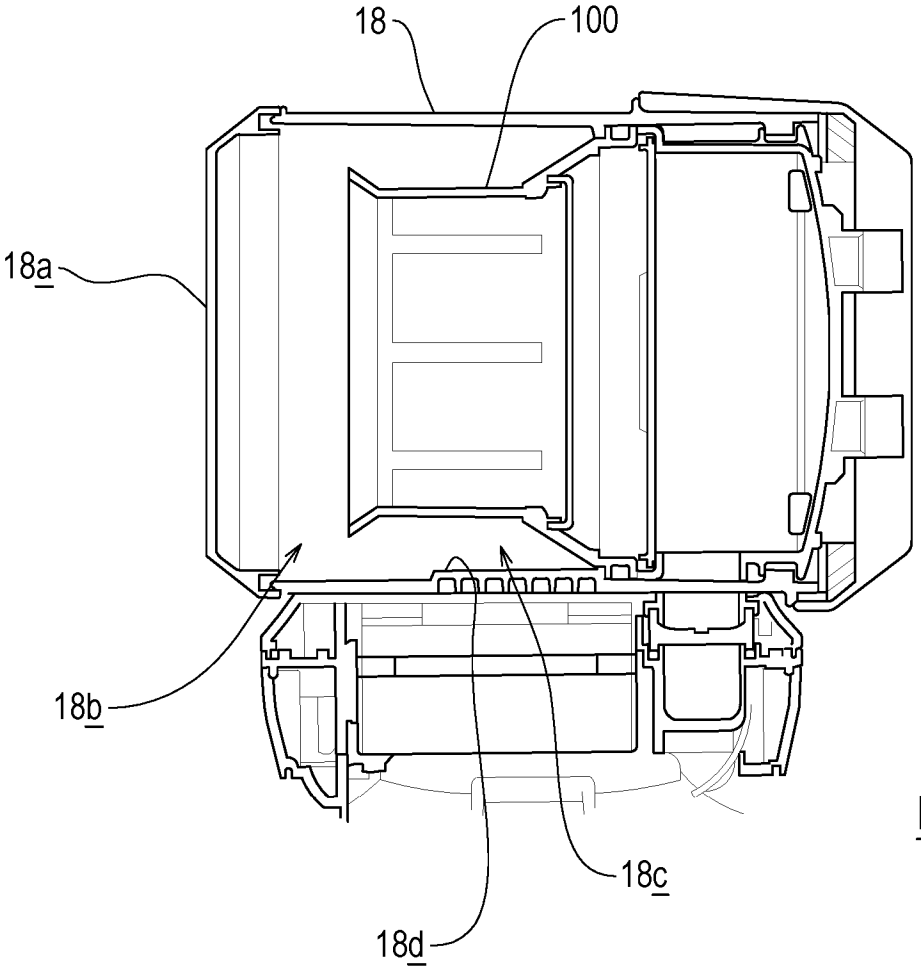
FIG. 8 is cross-sectional view of the apparatus through a central plane of a shroud.

Referring to the figures, these show a surface cleaning apparatus 10 in accordance with the present invention. The apparatus 10 includes a floor head 12, a housing 16 and an elongate member 14 connecting the floor head 12 to the housing 16. The housing 16 in this example is operable as a handheld surface cleaning apparatus, commonly known as a hand vac, when the elongate member 14 and floor head 14 are not connected thereto. The housing 16 supports a suction source, a dirt container 18 and a cyclonic separator. In this example the suction source is an electric motor driving a rotatable fan, but any appropriate suction source may be used. All that is necessary is for the suction source to be able to draw air through the floor head 12 and elongate member 14 towards the dirt collection container.

In this example the housing 16 supports or contains a battery to provide electrical power to the suction motor and other components of the apparatus 10. In alternative embodiments, the apparatus 10 may be mains powered.

Whilst in the present embodiment the apparatus 10 includes a cyclonic separator to separate dirt from the air flowing through the apparatus 10, this is not essential. Indeed, embodiments are envisaged where the apparatus 10 includes a filter bag which collects dirt, or any other appropriate device to separate the dirt from the air. The apparatus 10 includes a pivotally moveable door 18*a* which enables a user to empty dirt collected within the container 18.

The elongate member 14 includes a passage for carrying dirt-laden air from the floor head 12 to the dirt collection chamber 18. In this example the floor head 12 includes a motor for driving a rotatable floor agitating member or brush, so the elongate member 14 includes a further passage through which electrical cables may extend to provide an electric connection between the housing 16 and the motor in the floor head.

The floor head 12 is disconnectable from the elongate member 14, so that, for example, another tool can be connected to the free end of the elongate member 14. The elongate member 14 is also disconnectable from the housing 16, by way of a manually operated switch 17. This enables the housing 16 to be used as handheld surface cleaning apparatus, with the option of being able to connect another tool to the location from where the elongate member 16 is removed.

The housing 16 includes a handle for holding the apparatus 10, said handle including first 20 and second 21 user-graspable portions which are connected to each other substantially at right-angles. A first end of the first user-graspable portion 20 is connected to the housing 16 and extends generally rearwardly away therefrom and from the elongate member 14. A first end of the second user-graspable portion 21 is connected to the housing 16 and extends generally upwardly therefrom. Respective second ends of the first 20 and second 21 user-graspable portions are connected to each other. Essentially, the first 20 and second 21 user-graspable portions form a handle which is L-shaped and which provides two locations which of which is sized such that it can be grasped fully by a hand of a user. A device 22, e.g. a switch, for turning the apparatus "on" is positioned at the connection of the second ends of the first 20 and second 21 user-graspable portions to each other.

In the present embodiment, the generally cylindrical body 18 has an elongate axis A and provides at one end a dirt collection chamber 18*b* and an adjacent a separating chamber 18*c*. Within the chamber 18*c* is positioned a cyclonic separation device including a shroud 100 which also has an elongate axis coaxial with the axis A, the axis A being that about which dirt-laden air is caused to rotate as it passes through the apparatus 10 and circulates around the shroud 100. The shroud 100 is connected to the separating chamber 18*b* at one end and is free at an opposite end. The body 18 includes an inlet 99 through which dirt-laden air is drawn into the separating chamber 18*c*. The inlet 99 is configured to direct the incoming dirt-laden air into the generally cylindrical portion of the separating chamber 18*c* such that it travels circumferentially around an inner surface 18*d* of the separating chamber 18*c*. The elongate axis A is substantially horizontal in normal use. Whilst in this embodiment the elongate axes of the dirt collection chamber 18 and the shroud 100 are coaxial or substantially coaxial, they need not be. They could, for examples, be parallel and offset from each other or inclined relative to each other. Alternatively, the shroud 100 could be positioned generally centrally of the generally cylindrical portion of the separating chamber 18.

The shroud 100 includes a framework to support a mesh or the like (not shown) and is generally cylindrical with openings 104 therein for the passage of air to an outlet through which cleaner air exits the separating chamber. Other configurations of the shroud 100 are envisaged, for example removing the mesh covering and instead making the openings 104 smaller and greater in number. In general terms, the shroud 100 provides a plurality of openings 104 for the passage of air to the outlet.

Advantageously, the separating chamber includes an airflow directing formation 120 which is connected to the inner surface of the generally cylindrical portion and which extends inwardly towards the central axis A. In general terms, the airflow directing formation 120 extends away from the inlet 99 (i.e. towards the pivotally moveable door 18*a*) as it extends circumferentially around the inner surface of the generally cylindrical portion. In this way, the airflow directing formation 120 provides a surface which follows a substantially helical path as it extends away from the inlet and around the inner surface. As shown in the figures, the airflow directing formation 120 is connected only to the inner surface of the generally cylindrical portion of the separating chamber.

Figure 9:
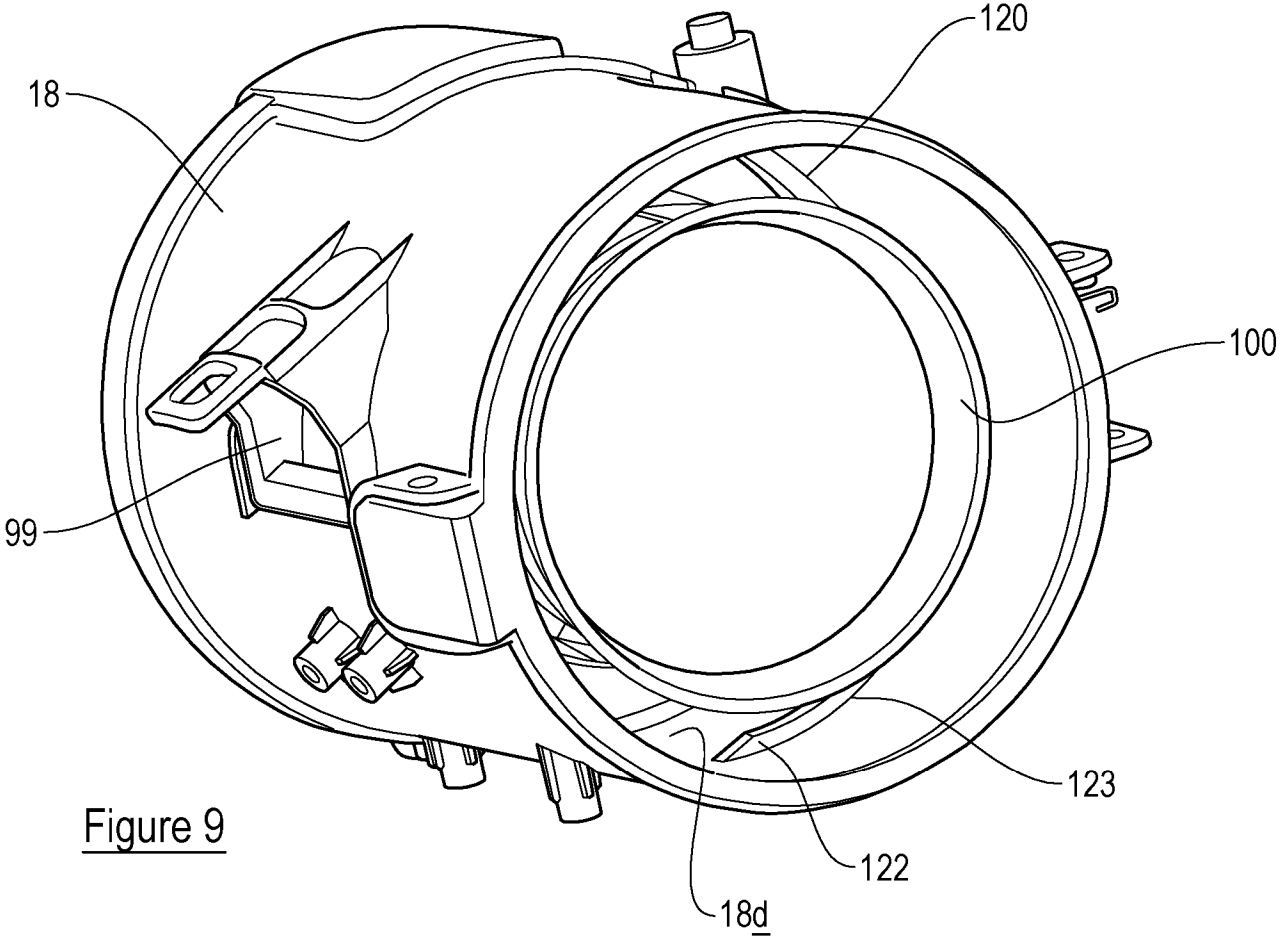
FIG. 9 is a perspective view of a dirt collection chamber and cyclonic separation device of the apparatus.
Figure 10:
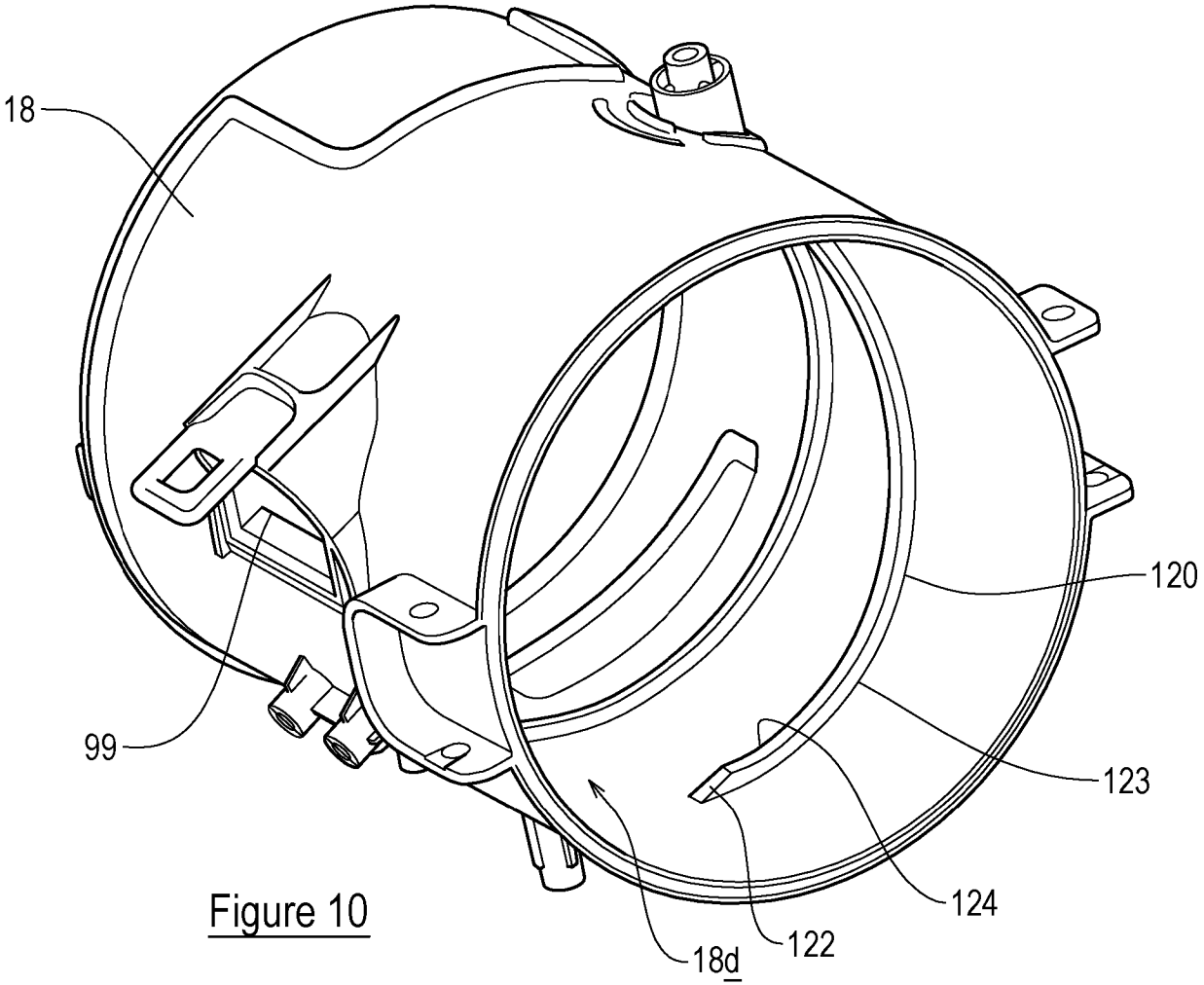
FIG. 10 is a perspective view of the dirt collection chamber.
Figure 11:
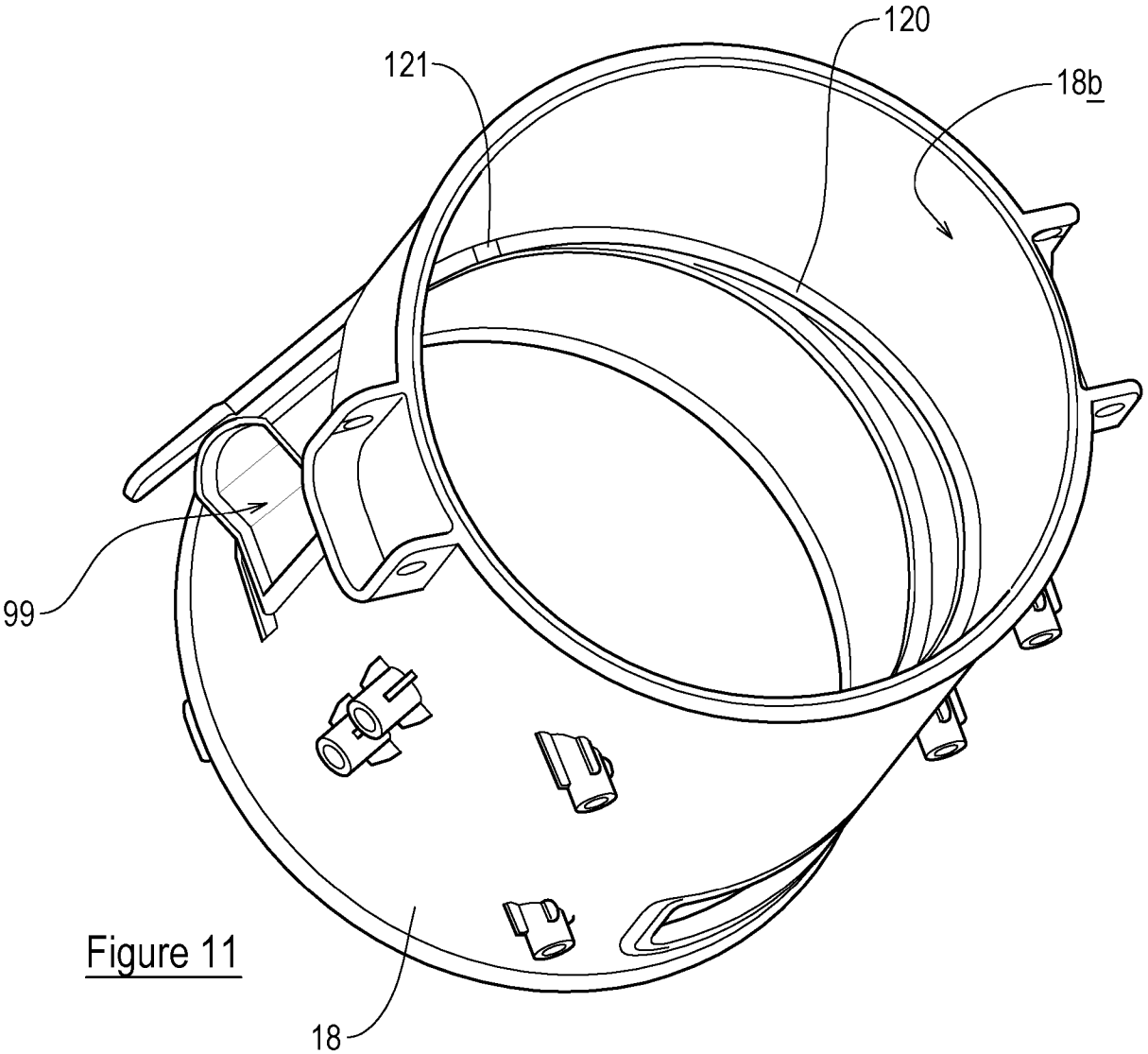
FIG. 11 is a further perspective view of the dirt collection chamber.
Figure 12:
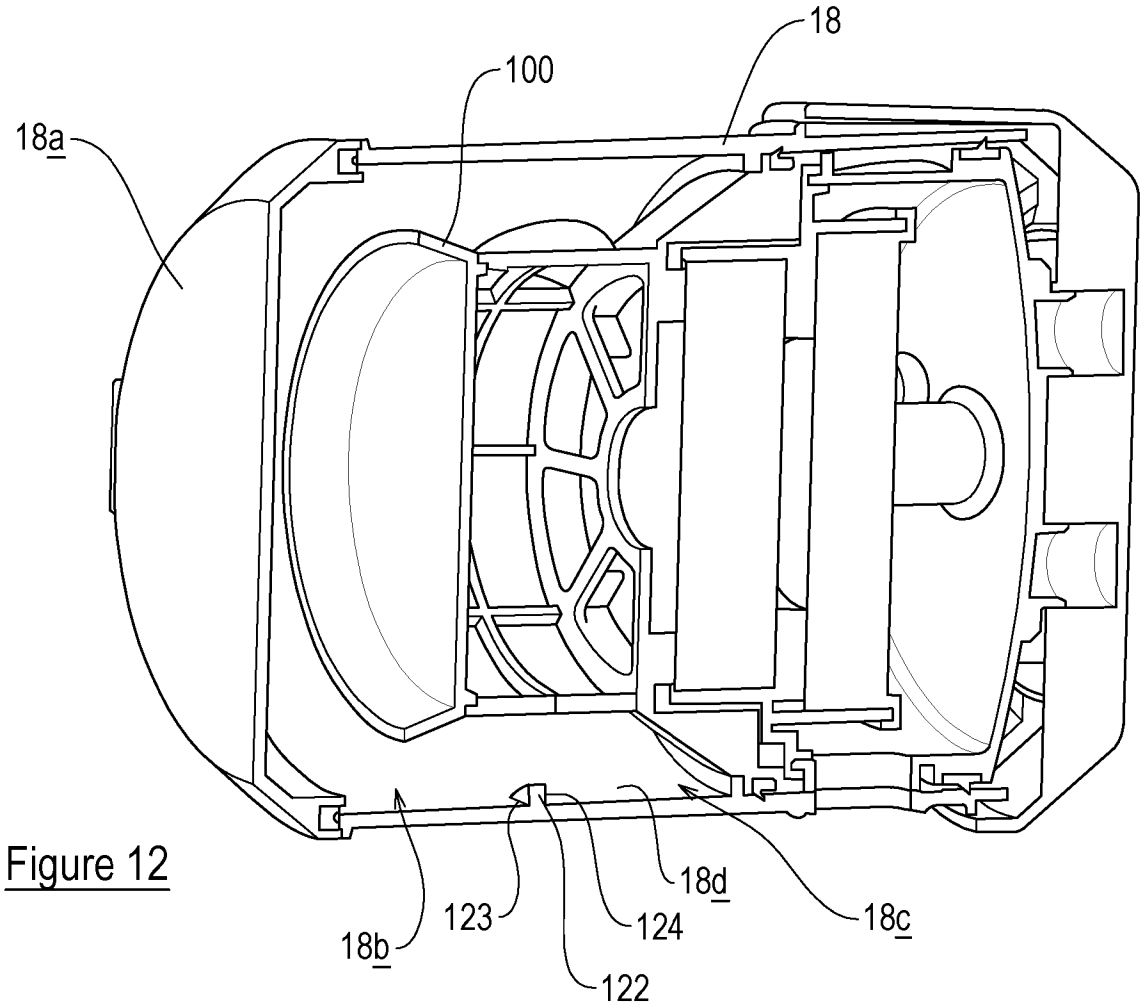
FIG. 12 is a perspective cross-sectional view of the dirt collection chamber and cyclonic separator through a plan which intersects its axis A.
Figure 13:
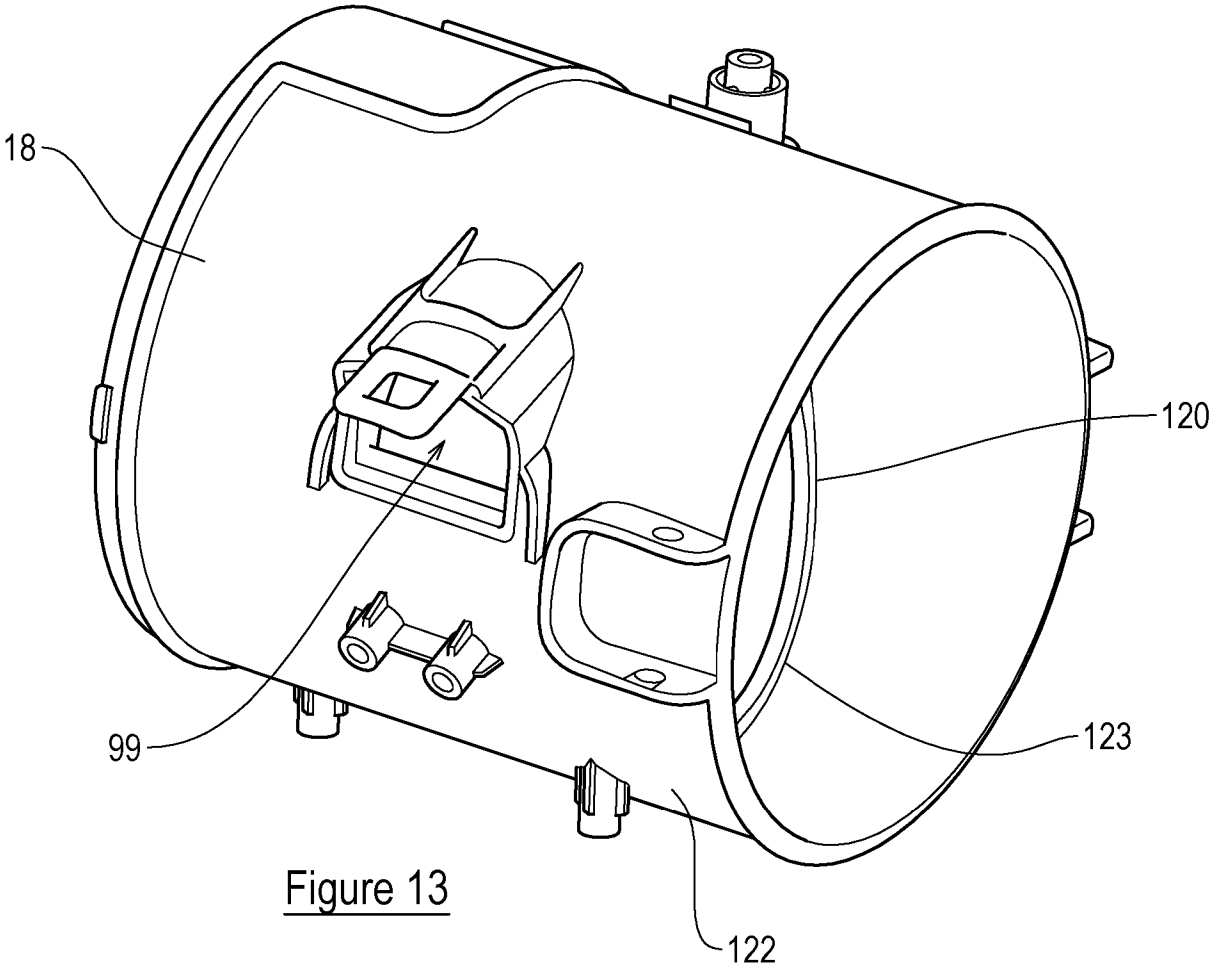
FIG. 13 is a yet perspective view of the dirt collection chamber.

In the present example, the airflow directing formation 120 has a first end 121 and a second end 122, with the second end 122 of the airflow directing formation being positioned remote from the inlet 99. The first end 121 is positioned adjacent or close to the inlet 99 so as to be able to affect the flow of air coming through the inlet 99. The second end 122 is positioned adjacent or close to the dirt collecting chamber 18*b*, and in this example is positioned adjacent or close to a free end (i.e. the skirt) of the shroud 100 (see FIG. 9). The second end 122 tapers towards the inner surface of the generally cylindrical portion.

In the present example it will be seen that the formation 120 takes the form of a helix/part helix, with a constant or substantially constant cross-sectional area as it extends circumferentially around the inner surface of the generally cylindrical portion. In this example the cross-sectional shape is rectangular, with axially facing surfaces 123, 124 (which also oppose each other) which provide surfaces which follow a helical or substantially helical path. Thus, the formation 120 has a width W measured in a direction parallel to the central axis A which is constant or substantially constant along its length. W is preferably in the range of 2 mm to 5 mm, most preferably in the range 2 mm to 4 mm, even more preferably in the range 2.5 mm to 3.5 mm. In this particular example, W is 3 mm. Is should be noted that the formation 120 may have a draft profile (it may taper), e.g. in view of being manufactured by injection moulding. Thus, the dimension W is preferably measured at or near its base, closest to the inner surface of the generally cylindrical portion. The free end of the formation 120 will have a smaller width dimension.

Likewise, the airflow directing formation 120 extends inwardly towards the axis A preferably by a distance D. D is preferably in the range of 2 mm to 5 mm, most preferably in the range 2 mm to 4 mm, even more preferably in the range 2 mm to 3 mm. In this particular example, D is 2.9 mm.

Figure 14:
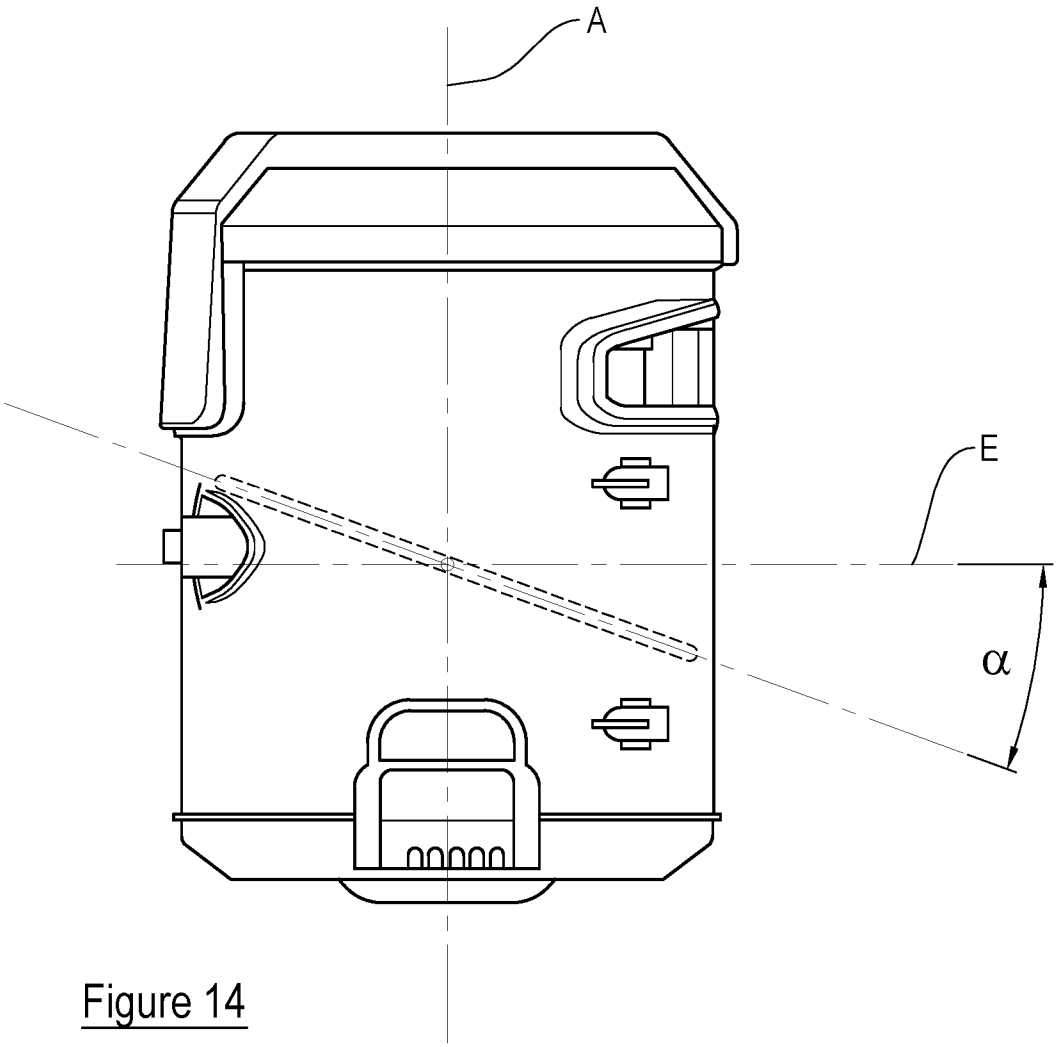
FIG. 14 is a plan view of the dirt collection chamber, with internal components shown.

It has advantageously been found that performance is optimised where an angle of inclination, a (see FIG. 14), of the formation 120 (and thus the surfaces 123, 124) is in the range of 10 to 30 degrees to a plane E which extends perpendicularly through the central axis A. Improved performance is achieved where the angle of inclination, a, in the range of 15 to 25 degrees. Most improved performance has been found where the angle of inclination, $\alpha$, is 20 degrees or about 20 degrees.

It will be seen from the figures that the formation 120 extends around the inner surface of the generally cylindrical portion for less than one complete revolution of the axis A. Rather, the formation 120 extends around the inner surface of the generally cylindrical portion for half or substantially half of one complete revolution of the axis A. Embodiments are envisaged, however, where the formation 120 extends around the inner surface of the generally cylindrical portion for more than one complete revolution of the axis A.

Figure 15:
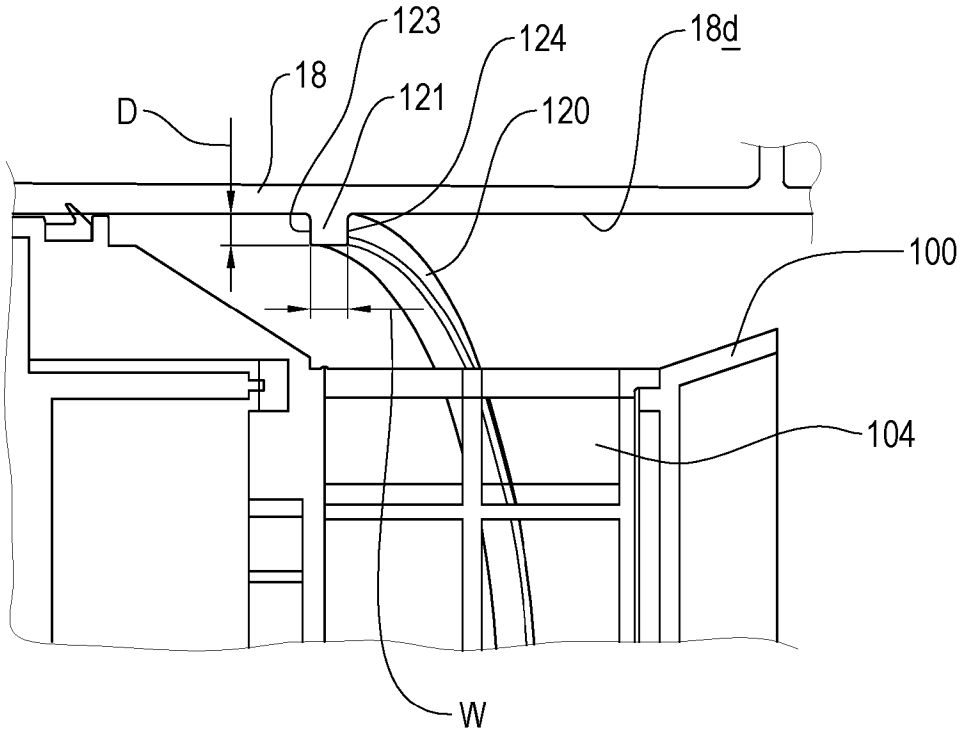
FIG. 15 is a magnified cross-sectional view of an area of the dirt collection chamber and cyclonic separation device.
Figure 16:
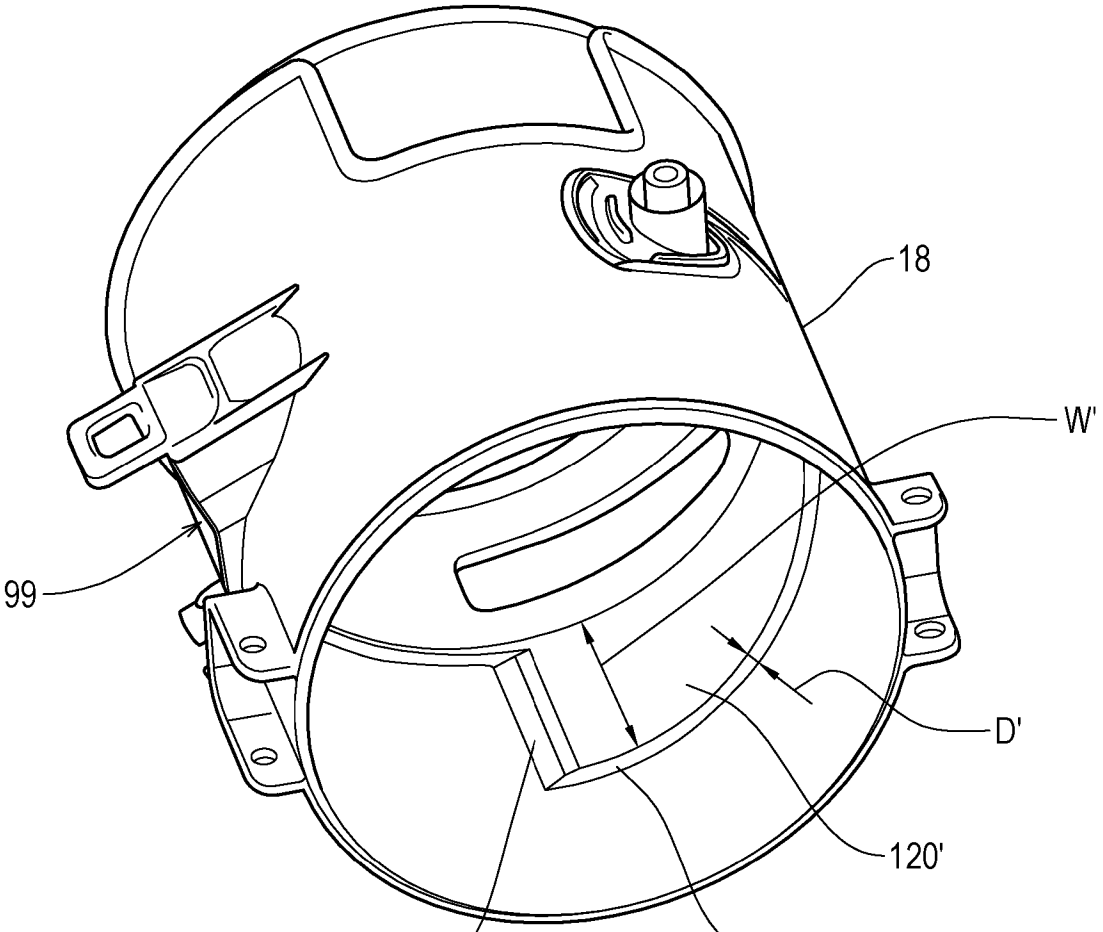
FIG. 16 is a perspective view of a dirt collection chamber and cyclonic separation device of a second embodiment.
Figure 17:
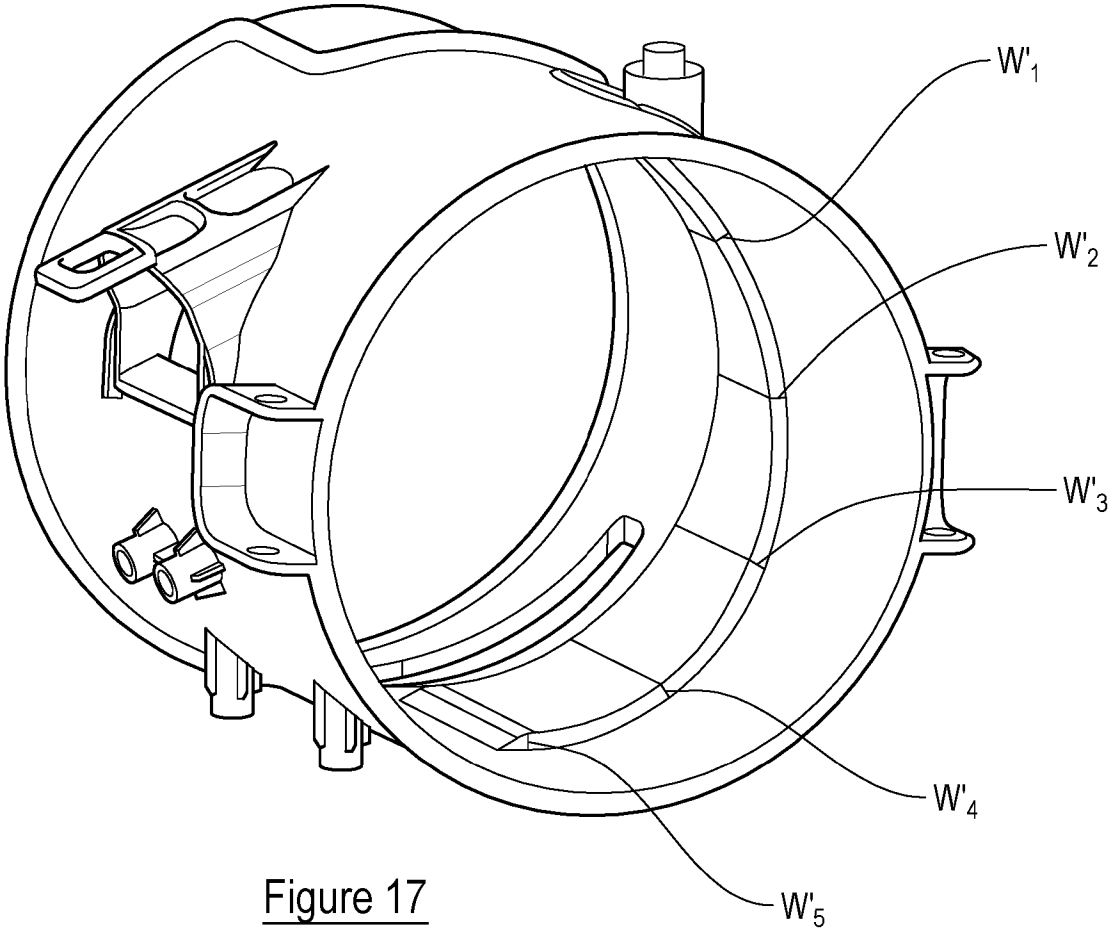
FIG. 17 is a further perspective view of dirt collection container and cyclonic separation device of FIG. 16.

FIG. 16 shows an alternative embodiment where the formation 120' is of a different shape. Instead of providing a helical formation which is of constant thickness and width (D' and W', in FIG. 15), the cross-sectional area of the airfow directing formation 120' increases as the formation 120' extends circumferentially around the inner surface of the generally cylindrical portion from tis first end 121' to its second end 122'. Dimension D' is the same (its preferred dimensional ranges) as that for the first embodiment. The width W of the formation 121' measured in a direction parallel to the central axis A increases as the formation 120' extends circumferentially around the inner surface of the generally cylindrical portion. FIG. 17 shows the increasing width of the formation at various positions W'1, W'2, W'3, W'4 and W'5, which in this example are respectively 12 mm, 21.9 mm, 31.8 mm, 39 mm and 39.5 mm. The positions W'1, W'2, W'3, W'4 and W'5 spaced from each other at 30 degrees about the axis A. Ranges around these values are envisaged, e.g. 2 mm-5 mm either side of the dimensions shown.

The formation 120' therefore provides only one helical surface 123' to affect airflow around the separator. Like in the first embodiment, it has advantageously been found that performance is optimised where an angle of inclination, a (see FIG. 14), of the surface 123' is in the range of 10 to 30 degrees to a plane E which extends perpendicularly through the central axis A. Improved performance is achieved where the angle of inclination, $\alpha$, in the range of 15 to 25 degrees. Most improved performance has been found where the angle of inclination, $\alpha$, is 20 degrees or about 20 degrees. An advantage of this embodiment is that manufacturing is less complex than the first embodiment.

In general terms, and in a preferred embodiment, the cyclonic separator device has:

a separating chamber;

an inlet through which dirt-laden air is drawn into the separating chamber;

an outlet through which cleaner air exits the separating chamber; and a dirt collection chamber in communication with the separating chamber, wherein the separating chamber includes a generally cylindrical portion with a central axis and wherein the inlet is configured to direct the incoming dirt-laden air into said generally cylindrical portion such that it travels circumferentially around an inner surface of the separating chamber, wherein the separating chamber includes an airflow directing formation which is connected to the inner surface of the generally cylindrical portion and which extends inwardly towards the central axis of the generally cylindrical portion, wherein said airflow directing formation extends away from the inlet as it extends circumferentially around the inner surface of the generally cylindrical portion.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A cyclonic separator device for removing dust or debris from dirt-laden air, the device comprising:

a separating chamber;

an inlet through which dirt-laden air is drawn into the separating chamber;

an outlet through which cleaner air exits the separating chamber; and a shroud that is connected to the separating chamber at one end, and provides a plurality of openings for the passage of air to the outlet, a dirt collection chamber in communication with the separating chamber, wherein the separating chamber includes a generally cylindrical portion with a central axis and wherein the inlet is configured to direct the incoming dirt-laden air into said generally cylindrical portion such that it travels circumferentially around an inner surface of the separating chamber, wherein the separating chamber includes an airflow directing formation which is connected to the inner surface of the generally cylindrical portion and which extends inwardly towards the central axis of the generally cylindrical portion, wherein said airflow directing formation provides a surface which follows a substantially helical path that extends away from the inlet as it extends circumferentially around the inner surface of the generally cylindrical portion less than one full revolution around the inner surface of the generally cylindrical portion.

2. A device according to claim 1 wherein the airfow directing formation is of substantially constant cross-sectional area as it extends circumferentially around the inner surface of the generally cylindrical portion.

3. A device according to claim 1 wherein a cross-sectional area of the airfow directing formation increases as the formation extends circumferentially around the inner surface of the generally cylindrical portion.

4. A device according to claim 1 wherein the airflow directing formation has a width measured in a direction parallel to the central axis of the generally cylindrical portion of the separating chamber, and where the width of the airflow directing formation is constant or substantially constant along its length.

5. A device according to claim 1 wherein the airflow directing formation has a width measured in a direction parallel to the central axis of the generally cylindrical portion of the separating chamber, and where the width of the airflow directing formation increases as the formation extends circumferentially around the inner surface of the generally cylindrical portion.

6. A device according to claim 1 wherein the airflow directing formation provides a single surface which follows a substantially helical path as it extends away from the inlet.

7. A device according to claim 6 wherein an angle of inclination of the surface is in the range of 10 to 30 degrees to a plane which extends perpendicularly through the central axis of the generally cylindrical portion.

8. A device according to claim 6 wherein an angle of inclination of the surface is in the range of 15 to 25 degrees to a plane which extends perpendicularly through the central axis of the generally cylindrical portion.

9. A device according to claim 6 wherein an angle of inclination of the surface is 20 degrees or about 20 degrees to a plane which extends perpendicularly through the central axis of the generally cylindrical portion.

10. A device according to claim 1 wherein the airflow directing formation is helical along substantially an entire length of the airflow directing formation.

11. A device according to claim 10 wherein an angle of inclination of the formation is in the range of 10 to 30 degrees to a plane which extends perpendicularly through the central axis of the generally cylindrical portion.

12. A device according to claim 10 wherein an angle of inclination of the formation is in the range of 15 to 25 degrees to a plane which extends perpendicularly through the central axis of the generally cylindrical portion.

13. A device according to claim 10 wherein an angle of inclination of the formation is 20 degrees or about 20 degrees to a plane which extends perpendicularly through the central axis of the generally cylindrical portion.

14. A device according to claim 1 wherein the airflow directing formation extends around the inner surface of the generally cylindrical portion for approximately half of one complete revolution.

15. A device according to claim 1 wherein the airflow directing formation is the only airflow directing formation provided on the inner surface of the generally cylindrical portion extends.

16. A device according to claim 1 wherein the airflow directing formation has a first end and a second end, wherein the second end of the airflow directing formation is positioned remote from the inlet.

17. A device according to claim 16 wherein the first end of the airflow directing formation is positioned adjacent or close to the inlet.

18. A device according to claim 16 wherein the second end of the airflow directing formation is positioned adjacent or close to the dirt collecting chamber.

19. A device according to claim 1 wherein the device includes the shroud positioned upstream of the outlet, the shroud being positioned generally centrally of the generally cylindrical portion of the separating chamber, and wherein the second end of the airflow directing formation is positioned adjacent or close to a free end of the shroud.

20. A device according to claim 19 wherein the shroud includes a peripheral skirt which extends towards the inner surface of the separating chamber and wherein the second end of the airflow directing formation is positioned adjacent or close to a free end of the skirt.

21. A device according to claim 1 wherein the airflow directing formation extends inwardly in the range of 2 mm to 5 mm towards the central axis of the generally cylindrical portion.

22. A device according to claim 1 wherein the airflow directing formation extends inwardly in the range of 2 mm to 3 mm towards the central axis of the generally cylindrical portion.

23. A device according to claim 1 wherein the airflow directing formation extends inwardly about 2.9 mm towards the central axis of the generally cylindrical portion.

24. A surface cleaning apparatus including a separator, the separator comprising:

a separating chamber;

an inlet through which dirt-laden air is drawn into the separating chamber;

an outlet through which cleaner air exits the separating chamber; and a shroud that is connected to the separating chamber at one end, and provides a plurality of openings for the passage of air to the outlet, a dirt collection chamber in communication with the separating chamber, wherein the separating chamber includes a generally cylindrical portion with a central axis and wherein the inlet is configured to direct the incoming dirt-laden air into said generally cylindrical portion such that it travels circumferentially around an inner surface of the separating chamber, wherein the separating chamber includes an airflow directing formation which is connected to the inner surface of the generally cylindrical portion and which extends inwardly towards the central axis of the generally cylindrical portion, wherein said airflow directing formation provides a surface which follows a substantially helical path that extends away from the inlet as it extends circumferentially around the inner surface of the generally cylindrical portion, and wherein the first end of the airflow directing formation is positioned adjacent or close to the inlet.

25. A device according to claim 24 wherein the airflow directing formation extends around the inner surface of the generally cylindrical portion for less than one complete revolution.

26. An apparatus according to claim 24 including:

a floor head;

a housing supporting a suction source; and an elongate member connecting the floor head to the housing, said elongate member including a passage for carrying dirt-laden air from the floor head to the dirt collection container.

27. An apparatus according to claim 26 wherein the elongate member is disconnectable from the floor head.

28. An apparatus according to claim 27 wherein the housing is operable as a handheld surface cleaning apparatus when the elongate member and floor head are disconnected therefrom.

29. An apparatus according to claim 26 wherein the elongate member is disconnectable from the housing.

* * * * *